US005890711A

United States Patent [19]

Kim

[11] Patent Number: 5,890,711

[45] Date of Patent: Apr. 6, 1999

[54] PAPER FEEDING PRESSURE CONTROL APPARATUS FOR INK-JET PRINTER

[75] Inventor: An-Kuk Kim, Seongnam, Rep. of Korea

[73] Assignee: SamSung Electronics Co., Ltd., Kyungki-do, Rep. of Korea

[21] Appl. No.: 805,331

[22] Filed: Feb. 24, 1997

[30] Foreign Application Priority Data

Feb. 22, 1996 [KR] Rep. of Korea ..... 1996-4145

[51] Int. Cl.[6] ..... B65H 1/08

[52] U.S. Cl. ..... 271/127; 271/160; 271/171

[58] Field of Search ..... 271/126, 127, 271/145, 160, 171

[56] References Cited

U.S. PATENT DOCUMENTS

| | | | |
|---|---|---|---|
| 4,650,175 | 3/1987 | Wexler . | |
| 4,828,245 | 5/1989 | Shimogawara . | |
| 4,838,535 | 6/1989 | Yokoi et al. . | |
| 5,040,780 | 8/1991 | Lohrmann et al. . | |
| 5,335,899 | 8/1994 | Golicz . | |
| 5,348,283 | 9/1994 | Yanagi et al. . | |
| 5,443,252 | 8/1995 | Morinaga et al. | 271/127 |

FOREIGN PATENT DOCUMENTS

| | | | |
|---|---|---|---|
| 0037500 | 3/1977 | Japan | 271/127 |
| 0211239 | 9/1986 | Japan | 271/160 |
| 404313523A | 11/1992 | Japan | 271/160 |
| 405069955A | 3/1993 | Japan | 271/160 |

*Primary Examiner*—H. Grant Skaggs
*Attorney, Agent, or Firm*—Robert E. Bushnell, Esq.

[57] ABSTRACT

A print media feeding apparatus is disclosed that can convey both thin documents and thick documents. By a simple manual manipulation, additional pressure can be exerted between the knock up plate and the pick up roller when thick documents are positioned therebetween. When thin documents are to be fed, less pressure is exerted by the knockup plate on the pick up roller. When thick sheets of paper are being conveyed, a bell crank is positioned to increase spring pressure on the documents. When thin papers are being conveyed, a bell crank is rotated to another position where the bell crank decreases from the spring pressure exerted on the knock up plate. By adjusting the pressure exerted on the documents, documents having varying thicknesses can be conveyed by the same feeding tray.

14 Claims, 4 Drawing Sheets

PAPER FEEDING PRESSURE CONTROL APPARATUS FOR INK-JET PRINTER

CLAIM OF PRIORITY

This application makes reference to, incorporates the same herein, and claims all benefits accruing under 35 U.S.C. §119 arising from an application for *Paper Feeding Pressure Control Apparatus For Ink-Jet Printer* earlier filed in the Korean Industrial Property Office on 22 Feb. 1996 and there duly assigned Ser. No. 4145/1996.

BACKGROUND OF THE INVENTION

1. Field of the Invention

The present invention relates to a media feeding control apparatus for an ink-jet printer. More particularly, it relates to an apparatus for controlling the pressure acting on print media that is fed by an automatic paper feeding apparatus of an ink-jet printer according to the thickness of the print media.

2. Description of the Related Art

The prior art contains many examples of individual feeders capable of feeding both thick documents and thin, or regular thickness documents using a single apparatus. For example, U.S. Pat. No. 5,335,899 for an *Apparatus And Method For Automatically Adjusting Sheet Feeding Pressure* to Golicz discloses a high speed sheet feeder that automatically adjusts for a wide variation in sheet thickness during operation. When a thick sheet of paper is encountered, less pressure is exerted on the pick-up roller. When a thin sheet of paper is encountered, a greater amount of pressure is exerted to convey the sheet of paper.

U.S. Pat. No. 4,828,245 for a *Sheet Feeder Suitable For Feeding Thick Sheets* to Shimogawara discloses a sheet feeder that can feed both thin and thick sheets of paper. An attach rent attaches to the conventional sheet storage cassette to enable both thin and thick sheets to be conveyed.

U.S. Pat. No. 5,348,283 for a *Sheet Feeding Apparatus Having Sheet Separating Means With Adjustable Feeding Force* to Yanagi, et al. discloses a sheet feeding apparatus having a sheet separating means with adjustable feeding force. The apparatus allows for thicker sheets such as postcards, envelopes and the like as well as plain sheets of paper to be manually inserted or to be automatically inserted into the sheet feeding apparatus.

U.S. Pat. No. 4,838,535 for a *Sheet Feeding Device With Detachable Holder Means For Thick Cut Sheets* to Yokoi, et al. discloses sheet feeding device with a detachable holder means for thick cut sheets. A holder containing thick cut sheets such as postcard is detachably mounted on the supporting structure. Yokoi '535 is intended to be compact in design, easy to operate, and does not require any exclusive driving means for thick paper feed, thus reducing manufacturing cost.

Finally, U.S. Pat. No. 5,040,780 for a *Sheet Feeding Apparatus For Separating Individual Sheets From Stacks of Sheets Of Different Relative Stiffness* to Lohrmann, et al. discloses a sheet feeding apparatus for separating individual sheets from stacks of sheets having a different relative stiffness. The invention uses a space saving arrangement for effectively accommodating to and separating individual sheets of various thicknesses from stacks of sheets in a sheet feeding apparatus.

What is needed is a simplified sheet feeder that allows for both the feeding of regular thickness sheets and extra thick sheets into an image formation device. By a single manual manipulation, the sheet feeder can convert from conveying thick sheets to conveying of regular sheets and vice versa.

SUMMARY OF THE INVENTION

It is an object of the present invention to provide a pressure controlled paper feeding apparatus for an ink-jet printer whereby a plurality of sheets of paper stacked on a paper feeder of the printer are automatically fed into the printer one by one.

It is another object of the present invention to provide a pressure controlled paper feeding apparatus for an ink-jet printer which controls the pressure acting on print media fed by an automatic paper feeding apparatus of an ink-jet printer according to the thickness of the print media.

It is another object to use a manually operated bell crank to switch between regular paper conveyance mode and thick paper conveyance mode.

In order to realize the above objects, the present invention provides a pressure controlled paper feeding apparatus for an ink-jet printer, including a frame, a tray joined to the upper part of the frame by a hinge, a paper guide that is movable to the left and to the right to direct the conveyance of paper, a compression spring installed between the frame and the tray, and a position control member installed on one edge of the tray to regulate the paper feeding pressure. The position control member has a hinge on the center of its curved part to be mounted on the tray, and a spring installed between the tray and position control member. To feed thick print media into the printer, the position control member is unfolded and is supported by the frame so that the spring provides a little more pressure to both the tray and to the pickup roller, and paper is guided by the tray and delivered to a paper feed roller by the frictional force of the spinning pickup roller.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
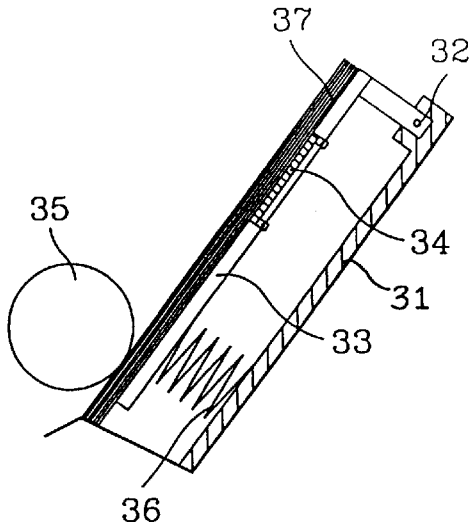
FIG. 1 is a side sectional view of a paper feeding apparatus of an ink-jet printer.

As shown in FIG. 1, a paper feeding apparatus of an ink-jet printer includes a frame 31, a tray, or knockup plate, 33 joined to the upper part of frame 31 by the use of a hinge 32, a paper guide 34 provided on one side of the tray 33 to direct thick print media, a pickup roller 35 placed on a vertical plane of the tray 33, and a compression spring 36 installed between the frame 31 and the tray 33. This compression spring 36 presses the tray 33 towards the pickup roller 35 so that paper 37 is guided by the tray 33 and conveyed by the frictional force of the spinning pickup roller 35.

When regular paper is being conveyed, the paper guide 34 delivers the paper to the pickup roller 35. When thick paper is being conveyed, the paper guide 34 delivers the thick paper to the pickup roller 35, being raised on the tray 33.

In the conventional paper feeding apparatus, the compression spring 36 installed between the tray and the frame of the tray 33 is designed to assist the regular paper to be smoothly delivered to the pickup roller 35. Thus, in case of using thick paper instead of the regular paper, the frictional force of the pickup roller 35 acting on the thick paper is not enough to reliably feed the paper into the printer, resulting in paper jams.

Figure 2:
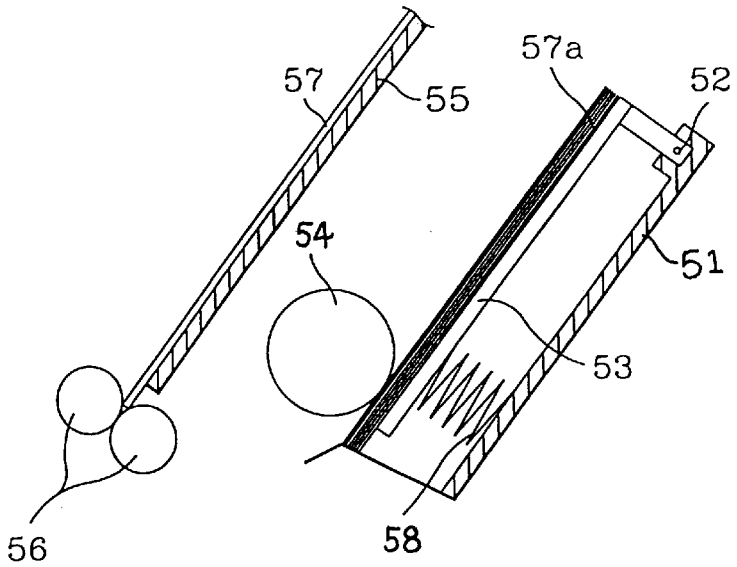
FIG. 2 is a side sectional view of a paper feeding apparatus of an ink-jet printer.
Figure 3:
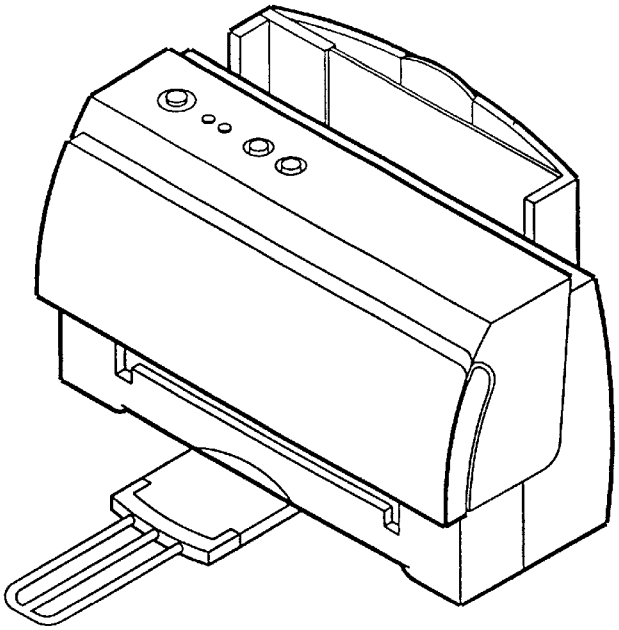
FIG. 3 is a perspective view of an ink-jet printer.

FIG. 2 shows another embodiment of an earlier paper feeding apparatus. The paper feeding apparatus includes a frame 51, tray 53 joined to the frame's upper part by the use of a hinge 52, a pickup roller 54 located on a vertical plane of the tray 53, and a compression spring 58 installed between the frame 51 and the tray 53. This compression spring 58 presses the tray 53 towards the pickup roller 54. The paper feeding apparatus also includes a paper guide 55 provided outside of the pickup roller 54 to feed thick paper 57, and a pair of manual feed rollers 56 installed below the paper guide 55. When feeding regular paper of standard thickness into the printer using such a paper feeding apparatus, sheets of paper are stacked on the tray 53 so they are guided by tray 53 and conveyed by ones by the frictional force of the pickup roller 54. In case of using thick paper, a sheet of thick paper is put on the paper guide 55 to be fed by a pair of the spinning manual feed rollers 56.

According to the earlier paper feeding system, users must take the trouble to manually feed sheets of thick paper one by one into the printer, and the paper feeder is of complicated structure, where thick papers are fed into a different tray than are regular papers.

Figure 4:
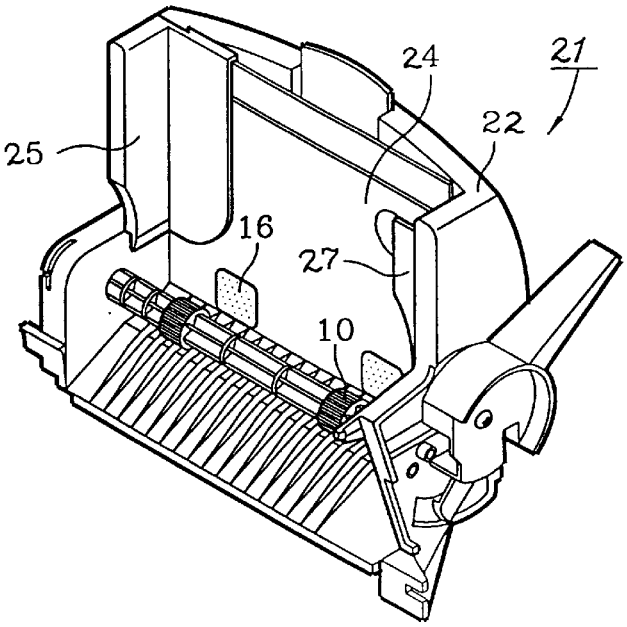
FIG. 4 is a perspective view of a paper feeding apparatus in accordance with the present invention.
Figure 5:
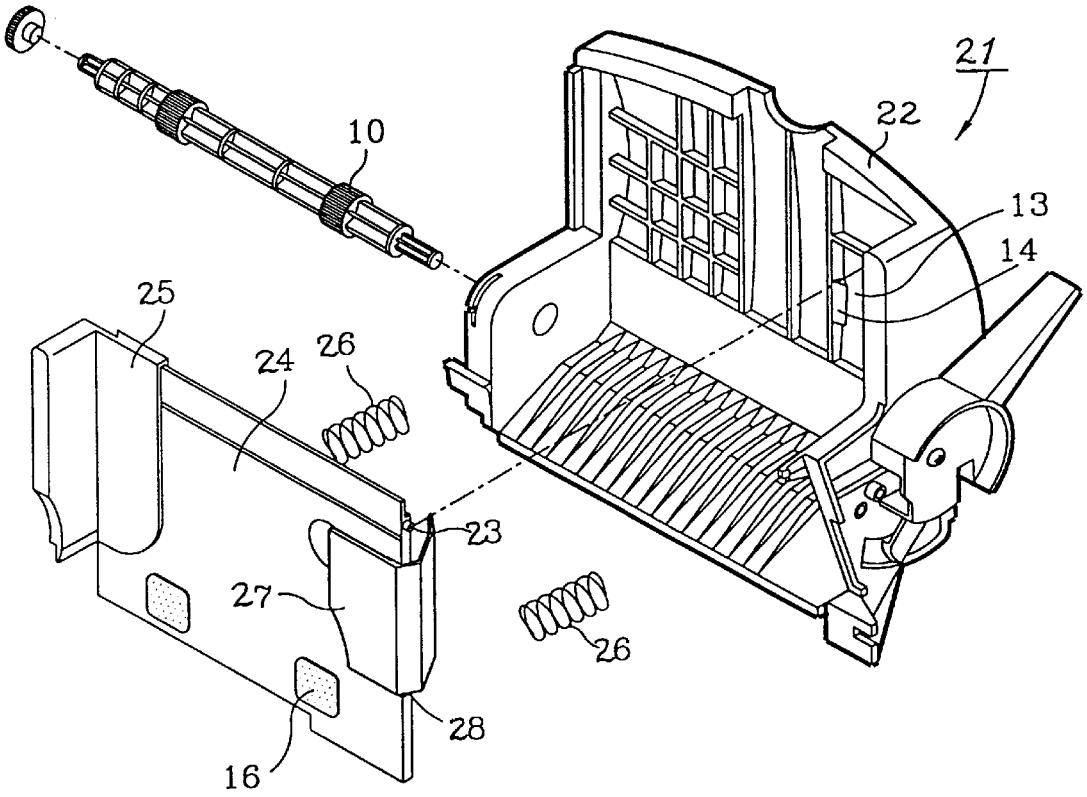
FIG. 5 is an exploded view of the paper feeding apparatus in accordance with the present invention.
Figure 6:
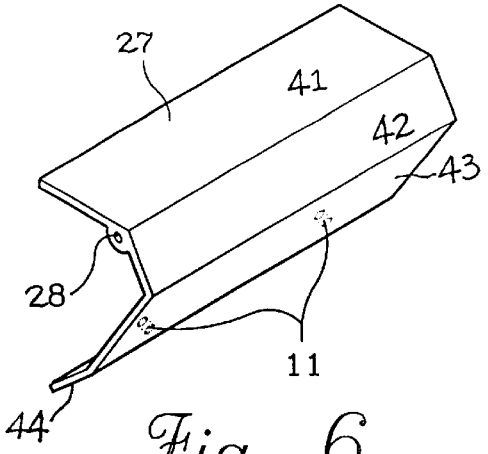
FIG. 6 is a paper control guide in accordance with the present invention.

Referring to FIGS. 4 and 5, the inventive automatic paper feeding apparatus 21 includes a frame 22, tray 24 joined to the frame 22 by the use of a hinge 23, a paper guide 25 moved to the left and right and directing the conveyance of paper, and compression springs 26 installed between the frame 22 and tray 24, and a pickup roller 10. The tray 24 has a recess or a cut out portion 45 on the top side thereof. The automatic paper feeding apparatus 21 also includes a position control member, or bent member 27 that is installed on one side of the tray 24 to regulate the paper feeding pressure acting on thick paper and having a hinge 28 located between the upper portion 41 and the second intermediate portion 42 of position control member 27. A spring, or pair of springs 29 is installed between the tray 24 and position control member 27. When the position control member 27 is unfolded, as in FIG. 7, it is supported by the frame 22 so that the tray 24 gives a little more pressure to the pickup roller 10. Paper 18 is guided by the tray 24 and conveyed by the frictional force of the spinning pickup roller 10. The tray 24 has a pair of pads 16 on both sides of the inner surface, and the position control member 27 has a lower portion 44, a first intermediate portion 43, a second intermediate portion 42, and a top portion 41. A pair of projections 12 are formed on the back of tray 24 and a pair of bosses 11 are disposed on the lower portion 44 of the position control member 27, corresponding to the projections 12 in order to elastically hold the springs 29. The springs 29 are compression coil springs.

Figure 7:
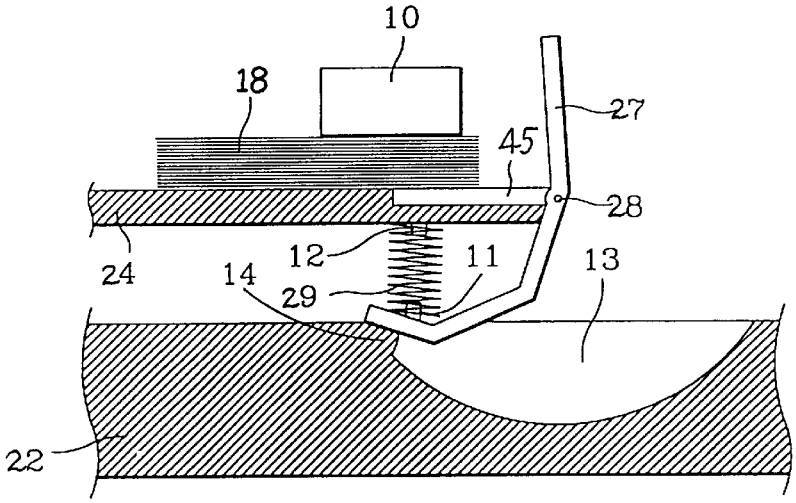
FIG. 7 is a view for describing the pressure controlled paper feeding in case of using thick paper.
Figure 8:
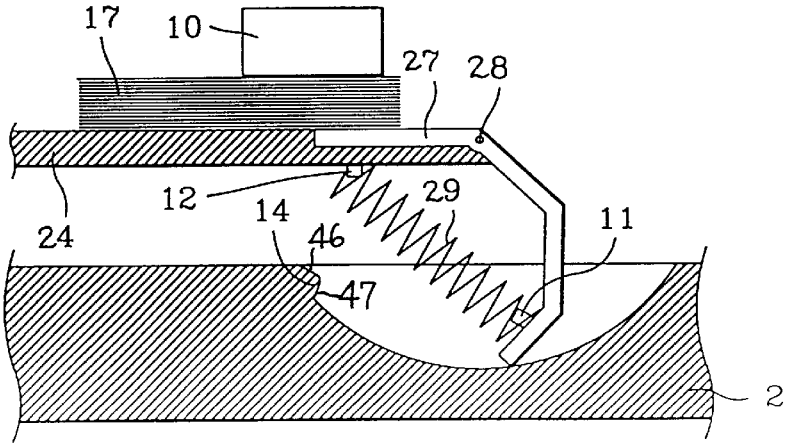
FIG. 8 is a view for describing the pressure controlled paper feeding in case of using regular paper.

Referring to FIGS. 7, and 8, the frame 22 has a groove, or recess, 13 on its back so as to accommodate the lower portion 44 of the position control member 27. Groove 13 has a lug, or bump, 14 on an upper portion of its inner wall, and the lower portion 44 of position control member 27 is held by groove 13, stepping across the lug 14. The lug 14 has an inclined portion 46 and an undercutting portion 47.

When regular paper is used in the inventive automatic paper feeding apparatus, the position control member 27 is in the position shown in FIG. 8. The position control member 27 formed on one side of tray 24 is rotated so that the upper portion 41 of position control member 27 is positioned inside recess 45 on the top side of tray 24, and after stacking sheets of regular paper 17 on the tray 24, the paper guide 25 is moved to align the sheets of paper 17. Tray 24 is forced against the pickup roller 10 by the frame 22 and the compression springs 26, and the pads 16 attached to both sides of the inner surface of tray 24 make the paper press up against the pickup roller 10. The frictional force of the pickup roller 10 allows a first sheet of the regular paper on tray 24 to be delivered to the printer's feed roller in such a manner that every sheet of the paper is delivered to the feed roller in sequence.

When thick paper is fed into the printer using the inventive automatic paper feeding apparatus, the position control member 27 is unfolded to the outside as shown in FIG. 7. The position of the position control member, or bent member, is referred to as the first position in the claims. Position control member 27 turns about hinge 28. The springs 29, that are elastically held between the bosses 11 of the position control member 27 and the projections 12 of the knock up plate 24 are compressed to push the position control member 27 to the outside so as to make it stand on the lower portion 44. The lower portion 44 of the position control member 27 moves upward stepping across the lug 14 whereby the position control member 27 is placed on the top of the lug 14. Tray 24 is pressed more toward the pickup roller 10, and the spring 29 becomes more compressed.

At this point, sheets of thick paper are stacked on tray 24, and the paper guide 25 is moved to align the sheets of paper 18. Tray 24 is more pressed toward the pickup roller 10 by the frame 22, the compression spring 26 and the position control member 27, and the pads 16 attached to both sides of the inner surface of tray 24 make the thick paper be situated close to the pickup roller 10. The frictional force of the spinning pickup roller 10 allows a first sheet of the thick paper on tray 24 to be delivered to the printer's feed roller in such a manner that every sheet of the paper is delivered to the feed roller in sequence.

When regular paper is fed into the printer, as the position control member 27 is pulled to be folded in a horizontal state as shown in FIG. 8. This position of the bent member is referred to as the second position in the claims. The lower portion 44 of the position control member 27 is moved downward, stepping over the upward inclined portion of the lug 14. As the position control member 27 crosses the lug 14, it is automatically folded up by the restoring force of the compression spring, or pair of springs, 29 installed under tray 24, and the lower portion 44 of position control member 27 is guided into groove 13 of frame 22 so that regular paper can be delivered to the printer's feed roller.

As described above, the inventive paper feeding apparatus includes a position control member on tray so as to increase the pressure applied to both the tray and the pickup roller when using thick paper during the paper feeding operation. Such an apparatus may prevent paper jams and helps to feed the paper more reliably and smoothly into the printer by controlling the paper feeding pressure depending on the position of the position control member.

Therefore, it should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. A media feeding apparatus having an adjustable pressure between a pickup roller and a tray, comprising:

a frame;

said tray pivotally attached to said frame and having a top surface and a bottom surface;

said pickup roller attached to said frame;

a bent member rotatably attached to an edge of said tray and having an upper portion and a lower portion, said bent member rotatable about said edge of said tray between a first position and a second position, while said bent member is in said first position said lower is portion is closer to said bottom surface of said tray than while said bent member is in said second position;

at least one elastic member disposed between said bottom surface of said tray and said lower portion of said bent member; and said bent member being rotatable between said second position, that causes said at least one elastic member to generate a first pressure on both said tray and said pickup roller, and said first position, that causes said at least one elastic member to generate a second pressure, greater than said first pressure, on both said tray and said pickup roller.

2. The media feeding apparatus according to claim 1, wherein said tray bears a pair of pads on said top surface.

3. The media feeding apparatus according to claim 1, wherein said bent member has a substantially "L"-shaped lower portion.

4. The media feeding apparatus according to claim 1, further comprising a pair of projections formed on said bottom surface of the tray and a pair of bosses disposed on said lower portion of said bent member, corresponding to the pair of projections, said pair of projections and said pair of bosses cooperating to hold said pair of elastic members.

5. The media feeding apparatus according to claim 4, further comprised of said at least one elastic member being a compression spring.

6. The media feeding apparatus according to claim 1, further comprised of said frame having a groove allowing said lower portion of said bent member to rotate through said groove.

7. The media feeding apparatus according to claim 6, further comprised of said groove having a bump on an edge of said groove, said lower portion of said bent member being engageable with said bump of said groove to brace said bent member in said first position.

8. The media feeding apparatus according to claim 7, further comprised of said bump having a slightly sloped portion and an undercut portion.

9. A print media feeding apparatus, comprising:

a frame having a groove;

a tray pivotally attached to said frame and having a top surface and a bottom surface;

a pickup roller attached to said frame;

a bent member pivotally attached to an edge of said tray and rotatable between a first position and a second position, said bent member rotatable through said groove in said frame;

an elastic member disposed between said bottom surface of said tray and an end of said bent member;

said bent member being rotatable between said second position, that causes said elastic member to generate a first pressure on both said tray and said pickup roller, and said first position, that causes said elastic member to generate a second pressure, greater than said first pressure, on both said tray and said pickup roller.

10. The print media feeding apparatus of claim 9, further comprised of said bent member having substantially a "J" shape, having a lower portion, and having a top portion, said bent member having a pivot point between said top portion and said lower portion.

11. The print media feeding apparatus of claim 10, further comprised of said groove having a bump along an edge.

12. The print media feeding apparatus of claim 11, further comprised of said lower portion of said bent member being disposed within said groove while said bent member is in said second position.

13. The print media feeding apparatus of claim 11, further comprised of said lower portion of said bent member being disposed on said bump on said edge of said groove while said bent member is in said first position.

14. A method of feeding thick sheets into an electrophotographic apparatus, comprising the steps of: removing a plurality of thin sheets of paper from a top side of a tray, said tray being pivotally supported in a frame, said frame supporting a pickup roller over said tray;

rotating a bent member about an edge of said tray between a first position and a second position, said bent member being attached to a lower surface of said tray via an elastic member that causes a greater pressure to be exerted on both said tray and said pickup roller while said bent member is in said first position;

inserting a plurality of thick sheets of paper on said top side of said tray between said tray and said pickup roller; and said pickup roller feeding said thick sheets, one by one, into said electrophotographic apparatus.

* * * * *